US011279133B2

(12) United States Patent
Yoshida et al.

(10) Patent No.: US 11,279,133 B2
(45) Date of Patent: Mar. 22, 2022

(54) INK JET DEVICE

(71) Applicant: Panasonic Intellectual Property Management Co., Ltd., Osaka (JP)

(72) Inventors: Hidehiro Yoshida, Osaka (JP); Yousuke Toyofuku, Osaka (JP); Kentaro Kumazawa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/028,462

(22) Filed: Sep. 22, 2020

(65) Prior Publication Data

US 2021/0094293 A1 Apr. 1, 2021

(30) Foreign Application Priority Data

Sep. 26, 2019 (JP) ..... JP2019-176070
Jul. 29, 2020 (JP) ..... JP2020-128361

(51) Int. Cl.

| | |
|---|---|
| ***B41J 25/00*** | (2006.01) |
| ***B41J 2/145*** | (2006.01) |
| ***B41J 2/045*** | (2006.01) |
| *B41J 11/00* | (2006.01) |
| *B41J 3/407* | (2006.01) |
| *B41J 2/155* | (2006.01) |
| *B41J 2/01* | (2006.01) |

(52) U.S. Cl.

CPC ..... *B41J 2/145* (2013.01); *B41J 2/04501* (2013.01); *B41J 25/003* (2013.01); *B41J 2/01* (2013.01); *B41J 2/155* (2013.01); *B41J 3/407* (2013.01); *B41J 11/001* (2013.01); *B41J 2202/15* (2013.01)

(58) Field of Classification Search

CPC ..... B41J 2/145; B41J 25/003; B41J 2/04501; B41J 2/155; B41J 2/01; B41J 11/001; B41J 3/407; B41J 2202/15

See application file for complete search history.

(56) References Cited

U.S. PATENT DOCUMENTS

| | | | | |
|---|---|---|---|---|
| 6,712,536 B2 * | 3/2004 | Miyano | B41J 11/46 | 347/116 |
| 2002/0044163 A1 * | 4/2002 | Shigemura | G02B 5/201 | 347/1 |
| 2002/0109741 A1 * | 8/2002 | Okabe | G02B 5/201 | 347/14 |

(Continued)

FOREIGN PATENT DOCUMENTS

| | | | |
|---|---|---|---|
| JP | 2006-272035 A | 10/2006 | |
| JP | 2013039762 A * | 2/2013 | B41J 2/01 |

*Primary Examiner* — Yaovi M Ameh

(74) *Attorney, Agent, or Firm* — Greenblum & Bernstein, P.L.C.

(57) ABSTRACT

The ink jet device is provided with a plurality of ink jet heads including a plurality of nozzles disposed linearly with each other at intervals in a predetermined longitudinal direction and ejecting ink in different regions each other in the printing width direction; and a position adjusting mechanism performing rotating operation of changing the intervals in the printing width direction of the nozzles by rotating the plurality of ink jet heads around an axis perpendicular to the print surface of the print object, and performing a shifting operation of shifting at least one of the plurality of ink jet heads in the printing width direction.

11 Claims, 14 Drawing Sheets

(56) References Cited

U.S. PATENT DOCUMENTS

| | | | | |
|---|---|---|---|---|
| 2006/0132530 | A1* | 6/2006 | Yasuda | B41J 29/393<br>347/19 |
| 2006/0216409 | A1 | 9/2006 | Mishima | |

* cited by examiner

INK JET DEVICE

TECHNICAL FIELD

The present invention relates to an ink jet device for applying ink to a print object by ejecting ink from a plurality of nozzles.

BACKGROUND ART

PTL 1 discloses an ink jet device for applying ink to a print object at intervals in a printing width direction perpendicular to a printing direction by ejecting ink from a plurality of nozzles disposed at intervals in the printing width direction. In this ink jet device, the plurality of nozzles is disposed linearly in a longitudinal direction of the ink jet head having an elongated shape at intervals from each other. The intervals in the printing width direction of the nozzles can be changed by rotating the ink jet head about an axis perpendicular to a print surface of the print object.

CITATION LIST

Patent Literature

PTL 1
Japanese Patent Application Laid-Open No. 2006-272035

SUMMARY OF INVENTION

Technical Problem

Since the ink jet device disclosed in PTL 1 includes only one ink jet head, it is necessary to lengthen the ink jet head in the printing width direction in the case where the print object is large-sized, such as a large display device and/or the like. However, if the ink jet head is too long, the influence of thermal expansion on the spacing of the nozzles becomes large.

In the case of dividing the print surface of the print object in the printing width direction, and printing another divided region after printing of a certain divided region in the entire printing direction is completed, the wet state and the degree of drying vary depending on the difference in printing timing, and printing unevenness occurs.

The present invention is made in view of the such a point, and an object thereof is to reduce printing unevenness occurring in a large print object without making the ink jet head too long.

Solution to Problem

In order to achieve the above object, the present invention provides an ink jet device configured to apply ink to a print object at intervals in a printing width direction perpendicular to a printing direction by ejecting ink from a plurality of nozzles disposed at intervals in the printing width direction, including: a plurality of ink jet heads including the plurality of nozzles disposed linearly with each other at intervals in a predetermined disposing direction, the plurality of ink jet heads ejecting ink in different regions each other in the printing width direction; and a position adjusting mechanism performing a rotating operation of changing the intervals in the printing width direction of the nozzles and performing a shifting operation of shifting at least one of the plurality of ink jet heads in the printing width direction, the rotating operation being performed by rotating the plurality of ink jet heads around an axis perpendicular to the print surface of the print object.

Thus, by ejecting ink in parallel with the plurality of ink jet heads, ink can be applied in a short time to a wider region in the printing width direction than the nozzle disposing region of each of ink jet heads. Therefore, it is possible to reduce printing unevenness occurring in the large print object without making the ink jet head too long.

Advantageous Effects of Invention

According to the present invention, it is possible to reduce printing unevenness occurring in the large print object without excessively lengthening the ink jet head.

DESCRIPTION OF EMBODIMENTS

Embodiments of the present invention will be described below with reference to the drawings.

Embodiment 1

Figure 1:
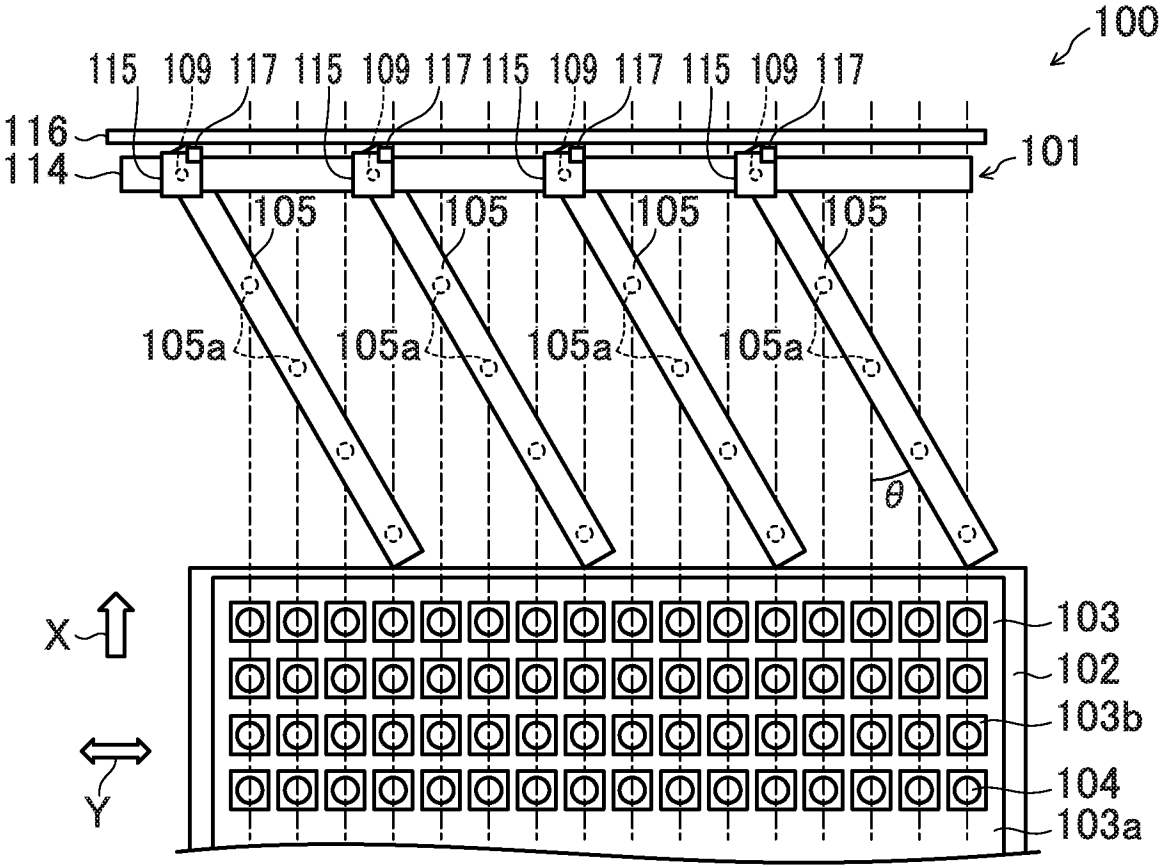
FIG. 1 is a schematic plan view of an inkjet apparatus according to Embodiment 1.

FIG. 1 illustrates ink jet device 100 according to Embodiment 1 of the present invention. Ink jet device 100 includes device main body 101, printing stage 102, and a conveying device (not illustrated) for moving printing stage 102 in predetermined printing direction X. Single display panel 103 as a print object is fixed to the upper surface of printing stage 102 by a method such as suction and/or the like with its surface facing upward. The surface of display panel 103 has a plurality of coloring regions 103*b* partitioned by banks 103*a*. Each of coloring regions 103*b* corresponds to one sub-pixel. Three sub-pixels of red, green, and blue are disposed in printing width direction Y to constitute one pixel. Printing width direction Y is a direction perpendicular to printing direction X. Ink 104 is applied to each of coloring regions 103*b*. Ink 104 is a quantum dot ink that emits red, green, or blue light.

Figure 2:
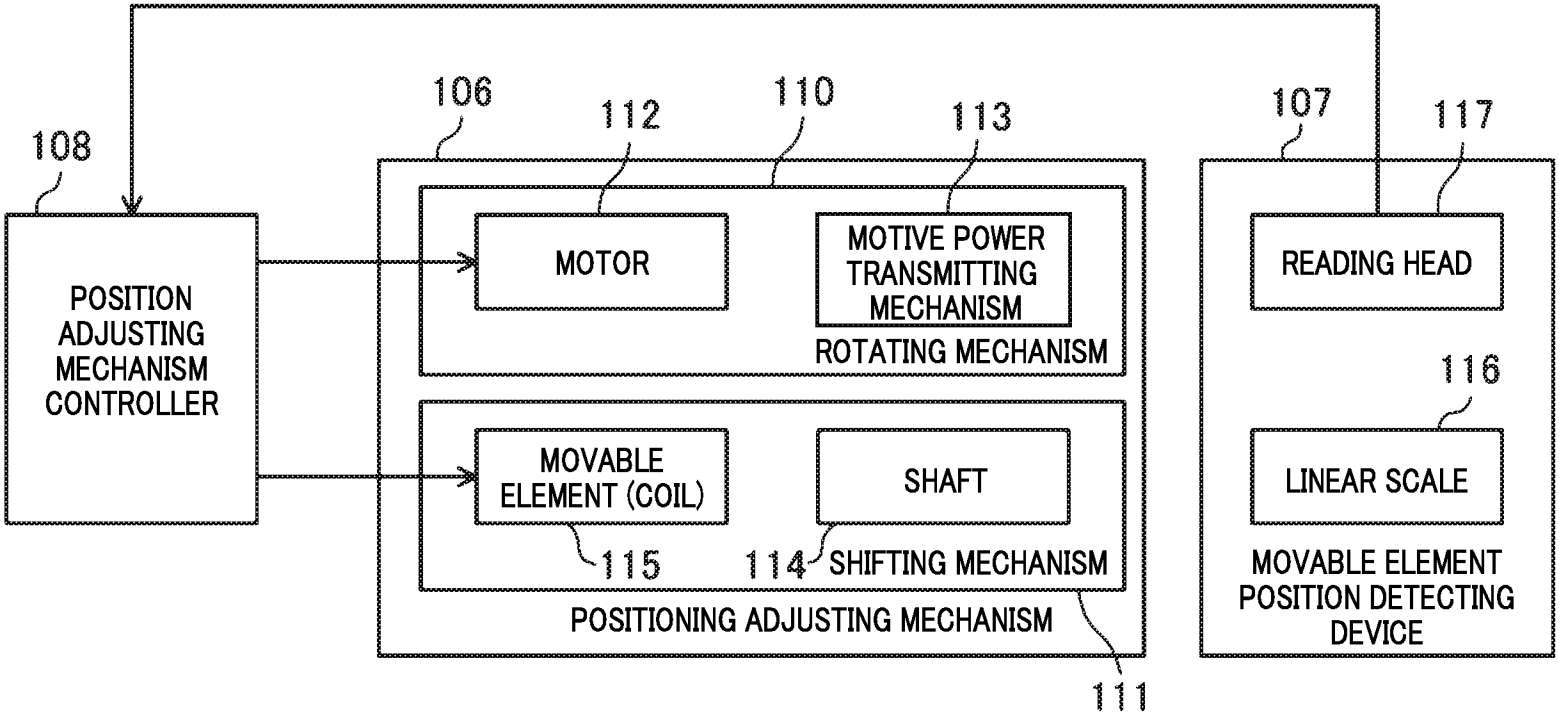
FIG. 2 is a block diagram of movable element position detecting device, position adjusting mechanism, and position adjusting mechanism controller of inkjet device according to Embodiment 1.

Device main body 101 has four elongated ink jet heads 105, position adjusting mechanism 106 illustrated in FIG. 2, movable element position detecting device 107, and position adjusting mechanism controller 108.

Ink jet head 105 is provided above printing stage 102. In each of ink jet heads 105, a plurality of nozzles 105*a* is linearly formed at equal intervals in the longitudinal direction. Each of nozzles 105*a* directs its ejection direction toward printing stage 102 side, that is, toward the lower side in FIG. 1. At one end of each of ink jet heads 105, rotating shaft 109 that projects upward or downward, that is, in a direction perpendicular to the print surface of display panel 103 is fixed. Rotating shaft 109 extends in a direction perpendicular to printing direction X and printing width direction Y. Note that as long as ink jet head 105 is rotatably configured by the power of motor 112 described later, rotating shaft 109 may not be. The plurality of nozzles 105*a* can be formed so as to be aligned on a straight line. When a plurality of nozzles 105*a* are aligned on the straight line in each of ink jet heads 105, a rotating operation and a shifting operation, which will be described later, can be performed individually for each row of nozzles. That is, the distance between the plurality of nozzles 105*a* in printing width direction Y can be adjusted more accurately. It is preferable that rotating shaft 109, that is, the rotation center shaft of ink jet head 105 is aligned on the straight line with the plurality of nozzles 105*a*. By disposing in this manner, the interval between adjacent nozzles 105*a* in printing width direction Y can be easily adjusted to a desired value by adjusting angle θ, which will be described later.

Position adjusting mechanism 106 adjusts the position of four ink jet heads 105. Position adjusting mechanism 106 has rotating mechanism 110, and shifting mechanism 111.

Rotating mechanism 110 rotates each of ink jet heads 105 around each of rotating shafts 109, thereby performing a rotating operation of changing the interval of nozzles 105*a* in printing width direction Y. Rotating mechanism 110 is configured so that an angle θ formed by the longitudinal direction of each of ink jet heads 105 relative to printing direction X can be changed to an angle in the range of 0 to 90 degrees. Specifically, rotating mechanism 110 has four motors 112 and four motive power transmitting mechanisms 113. A set composed of one motor 112 and one motive power transmitting mechanism 113 is attached to each of movable elements 115 to be described later. One end of each of ink jet heads 105 is connected to a corresponding one of motors 112 through rotating shaft 109 and motive power transmitting mechanism 113. Motive power transmitting mechanism 113 rotates rotating shaft 109, i.e., ink jet head 105 by transmitting the power of motor 112 to rotating shaft 109. Obviously, motor 112 may be directly connected to rotating shaft 109 or one end of ink jet head 105 not through motive power transmitting mechanisms 113.

Shifting mechanism 111 performs the shifting operation to shift each of ink jet heads 105 in printing width direction Y. Shifting mechanism 111 is a shaft motor having shaft 114 which is disposed so as to extend in printing width direction Y and in which the permanent magnet is incorporated, and four movable elements 115 incorporating a coil (electromagnet) wound so as to surround shaft 114 from the outer peripheral side. It is possible to move each of movable elements 115 to any position in printing width direction Y, by controlling the current flowing through the coil of each of movable elements 115. Movable element 115 and ink jet head 105 are connected through rotating shaft 109. Rotating mechanism 110 is attached to movable element 115. Therefore, ink jet head 105 and rotating mechanism 110 are movable in printing width direction Y along shaft 114 with movable element 115.

Movable element position detecting device 107 detects the position of each of movable elements 115. Movable element position detecting device 107 has linear scale 116, and reading head 117. Linear scale 116 is disposed so as to extend in printing width direction Y in parallel with shaft 114. Reading head 117 is fixed to each of movable elements 115. Each of reading heads 117 detects the position of movable elements 115 by reading the position information of linear scale 116.

Position adjusting mechanism controller 108 controls position adjusting mechanism 106 based on the detection result of movable element position detecting device 107. Position adjusting mechanism controller 108 stores in advance the interval in the longitudinal direction of nozzles 105*a* of each of ink jet heads 105. Position adjusting mechanism controller 108 calculates angle θ of each of ink jet heads 105 and the position of movable element 115 in printing width direction Y, based on the interval in printing width direction Y of coloring regions 103*b* in display panel 103 and the stored interval of nozzles 105*a*. Angle θ (hereinafter referred to as calculated angle θ) is calculated by the following equation (1).

[1]

$$\theta = \sin^{-1}\left(\text{interval of coloring regions } 103b / \text{interval of nozzles } 105a\right) \quad \text{(Equation 1)}$$

Position adjusting mechanism controller 108 controls position adjusting mechanism 106 so that four ink jet heads 105 eject ink 104 into different regions in the printing width direction each other.

The function of position adjusting mechanism controller 108 is realized by a CPU (Central Processing Unit) and/or the like such as a personal computer.

In ink jet device 100 configured as described above, the positions of nozzles 105*a* are adjusted as follows.

First, the user stores the interval in printing width direction Y of coloring regions 103*b* in display panel 103 as the print object and the interval in the longitudinal direction of nozzles 105*a* of each of ink jet heads 105 in position adjusting mechanism controller 108. Next, position adjusting mechanism controller 108 calculates angle θ of each of ink jet heads 105 and the position of movable element 115 in printing width direction Y based on the interval in printing width direction Y of coloring regions 103*b* in display panel 103 and the stored interval of nozzles 105*a*. Thereafter, position adjusting mechanism controller 108 causes rotating mechanism 110 to perform the rotating operation, so that the longitudinal direction of each of ink jet heads 105 forms angle θ relative to printing direction X. Thus, motor 112 is driven, the power of motor 112 is transmitted to rotating shaft 109 of each of ink jet heads 105 through motive power transmitting mechanisms 113, ink jet head 105 rotates around rotating shaft 109, and the longitudinal direction of each of ink jet heads 105 forms angle θ relative to printing direction X. Position adjusting mechanism controller 108 causes shifting mechanism 111 to perform the shifting operation, so that the position of movable element 115, that is, one end of each of ink jet heads 105 in printing width direction Y becomes the calculated positions, with reference to the detection result of movable element position detecting device 107. Specifically, movable element 115 is moved to any position in printing width direction Y, by controlling the current flowing through the coil of movable element 115. In this state, the plurality of nozzles 105*a* of each of ink jet heads 105 is disposed at intervals in printing width direction Y.

After completion of the position adjustment of ink jet heads 105, ink 104 is ejected simultaneously from the plurality of nozzles 105*a* of four ink jet heads 105 at each predetermined timing, while moving printing stage 102 in printing direction X at a constant speed in a state of fixing device main body 101. Four ink jet heads 105 eject ink 104 into different regions in the printing width direction. Ejected ink 104 is applied onto coloring regions 103*b* at intervals each other in printing width direction Y. Ink 104 ejected from each of nozzles 105*a* at a time is required to have a predetermined volume. When the volume of ink 104 varies, the brightness or the color tone of each pixel of display panel 103 varies, and the quality of display panel 103 is reduced. When ink 104 protrudes from coloring regions 103*b*, poor light emission or color mixing due to penetration of ink 104 into the adjacent coloring region 103*b* is caused. Therefore, it is important to accurately deposit ink 104 on each of coloring regions 103*b*.

In this manner, the positions of ink jet heads 105 can be automatically adjusted, by setting the interval in printing width direction Y of coloring regions 103*b* in display panel 103 as the print object in position adjusting mechanism controller 108. Thus, it is easy to perform the setting operation when changing the type of display panel 103 as the print object.

Therefore, according to Embodiment 1, it is possible to apply ink 104 to wider region in printing width direction Y than the region where nozzles 105*a* of ink jet heads 105 are disposed in a short time, by ejecting ink 104 from the plurality of ink jet heads 105 in parallel. Therefore, the printing unevenness occurring in large display panel 103 can be reduced without making ink jet head 105 too long.

Modification of Embodiment 1

In Embodiment 1, one display panel 103 as the print object is used; however, a plurality of display panels may be used. A plurality of types of display panels 103 having different intervals between coloring regions 103*b* may be disposed on printing stage 102 in printing width direction Y. Position adjusting mechanism controller 108 may store in advance the interval in printing width direction Y of coloring regions 103*b* in each of display panels 103, and may calculate angle θ of each of ink jet heads 105 and the position in printing width direction Y, based on the interval of coloring regions 103*b* in display panels 103 as the print object of each of ink jet heads 105 and the interval of nozzles 105*a* of each of ink jet heads 105. When the print object is not disposed in a part of a region in printing width direction Y on printing stage 102, ink jet head 105 may not be disposed at a position facing the region where the print object is not disposed, and ink jet head 105 may be concentratedly disposed at a position facing the region where the print object is disposed. Thus, the number of ink jet heads 105 can be reduced and the equipment can be reduced in weight.

Embodiment 2

Figure 3:
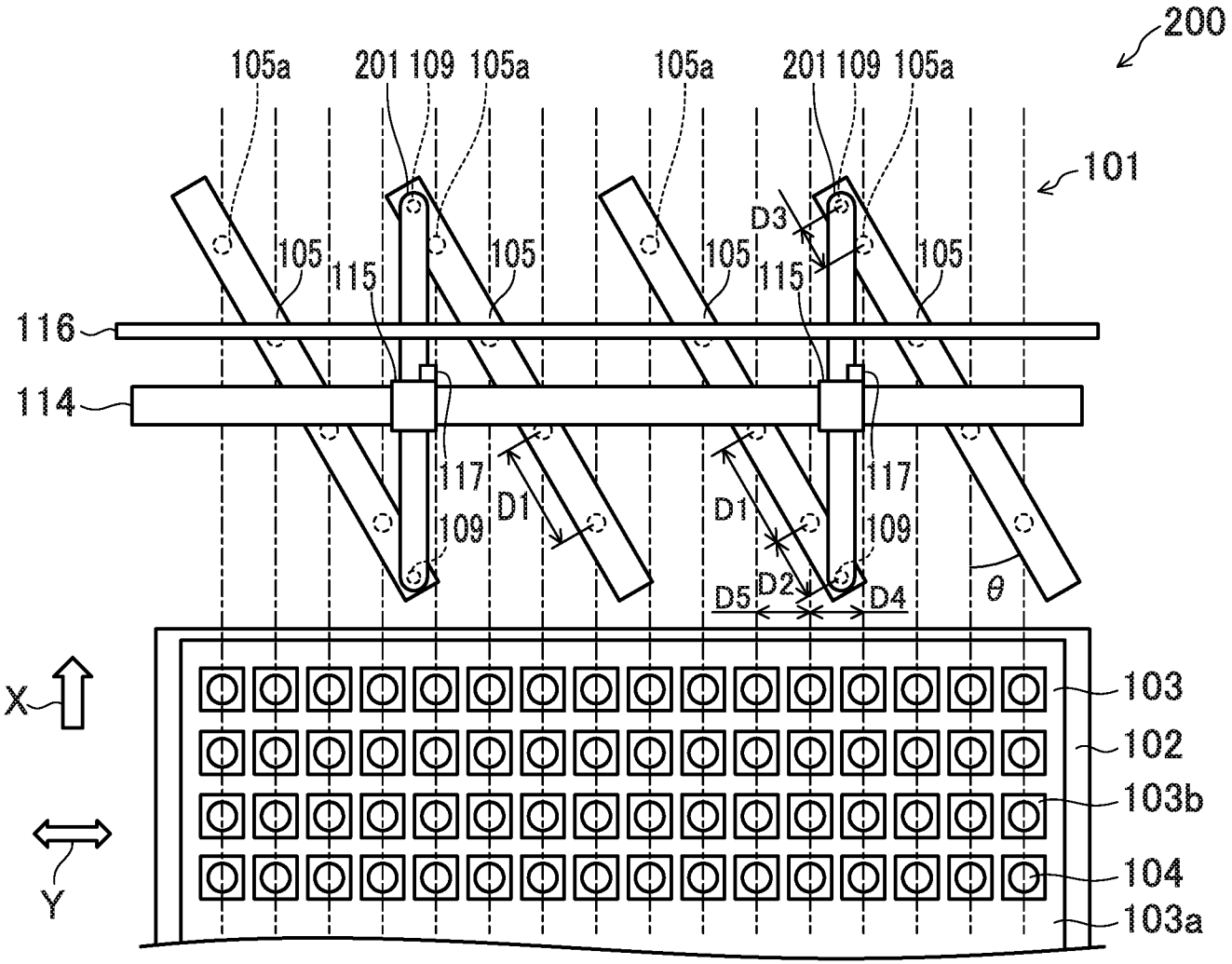
FIG. 3 is a diagram corresponding to FIG. 1 of Embodiment 2.

FIG. 3 illustrates ink jet device 200 according to Embodiment 2 of the present invention. In the present Embodiment 2, one end portions of two ink jet heads 105 adjacent to each other on both right and left sides (both sides in printing width direction Y) in FIG. 3 are connected to each other via frame 201 serving as an elongated connecting portion extending in printing direction X. The end of connecting frame 201 and the end of ink jet head 105 are connected through rotating mechanism 110 and rotating shaft 109. Movable element 115 is fixed to the center of connecting frame 201 in the longitudinal direction. Rotating mechanism 110 of each of ink jet heads 105 is attached to the end of connecting frame 201 rather than movable element 115. That is, at both ends of one connecting frame 201, a pair of motors 112 configuring rotating mechanism 110 are attached, respectively, and a pair of motive power transmitting mechanisms 113 are attached, respectively. One end portion of one of two adjacent ink jet heads 105 is connected to one of the pair of motors 112 directly, or through motive power transmitting mechanism 113 and rotating shaft 109. One end portion of the other one of two adjacent ink jet heads 105 is also connected to the other one of the pair of motors 112 directly, or through motive power transmitting mechanism 113 and rotating shaft 109. Thus, two adjacent ink jet heads 105 and one connecting frame 201 connected thereto are disposed in a Z-shape in a plan view. Note that one rotating center (e.g., rotating shaft 109) of two ink jet heads 105 and the other rotating center (e.g., rotating shaft 109) of two adjacent ink jet heads 105 are aligned on the straight line parallel to printing direction X. As long as this relationship is satisfied, the connecting portion may not have an elongated shape like connecting frame 201.

In Embodiment 2, interval D1 between nozzles 105*a* of four ink jet heads 105 is set to a common length. Position adjusting mechanism controller 108 calculates a common value as angles θ of four ink jet heads 105. The sum of interval D2 between nozzle 105*a* nearest from rotating shaft 109 of ink jet head 105 illustrated on the left side in FIG. 3 across connecting frame 201 and rotating shaft 109, and interval D3 between nozzle 105*a* nearest from rotating shaft 109 of ink jet head 105 illustrated on the right side in FIG. 3 across connecting frame 201 and rotating shaft 109 is equal to interval D1 of nozzles 105*a* adjacent in each of ink jet heads 105. That is, the following equation 2 is established.

[2]

$$D1=D2+D3 \quad \text{(Equation 2)}$$

Therefore, interval D4 of nozzles 105*a* adjacent to each other between the pair of ink jet heads 105 connected each other by connecting frame 201 in printing width direction Y becomes equal to interval D5 of nozzles 105*a* adjacent to each other in each of ink jet heads 105 in printing width direction Y.

Since the other configuration is the same as that of Embodiment 1, the same components are denoted by the same reference numerals, and detailed description thereof is omitted.

Therefore, according to Embodiment 2, since the number of movable element 115 can be reduced by half, it is possible to reduce the cost and the weight of ink jet device 200.

Modification of Embodiment 2

In Embodiment 2, two ink jet heads 105 are connected to each other by connecting frame 201, however, two or more ink jet heads 105 may be connected by connecting frame 201.

Embodiment 3

Figure 4:
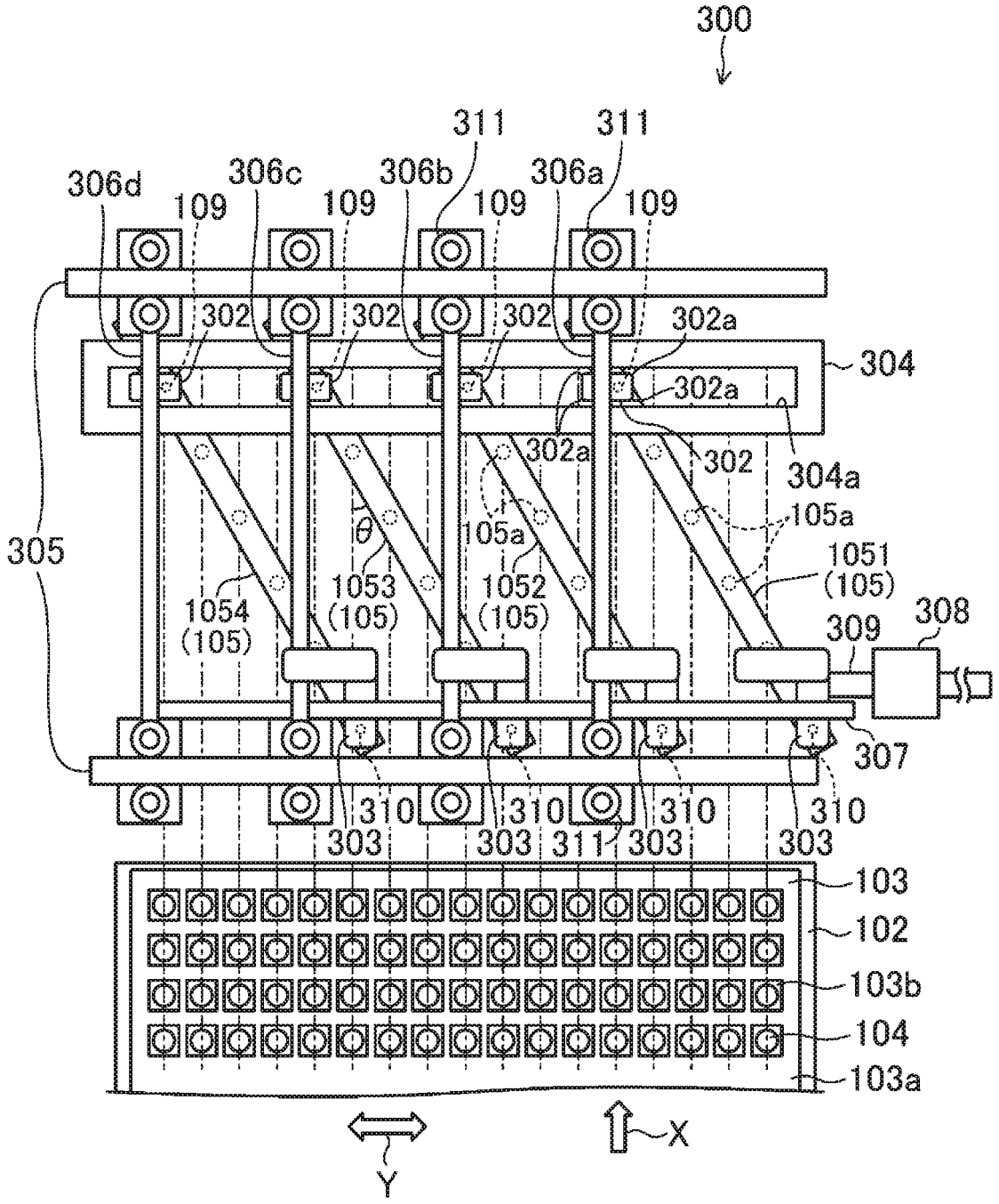
FIG. 4 is a diagram corresponding to FIG. 1 of Embodiment 3.
Figure 5:
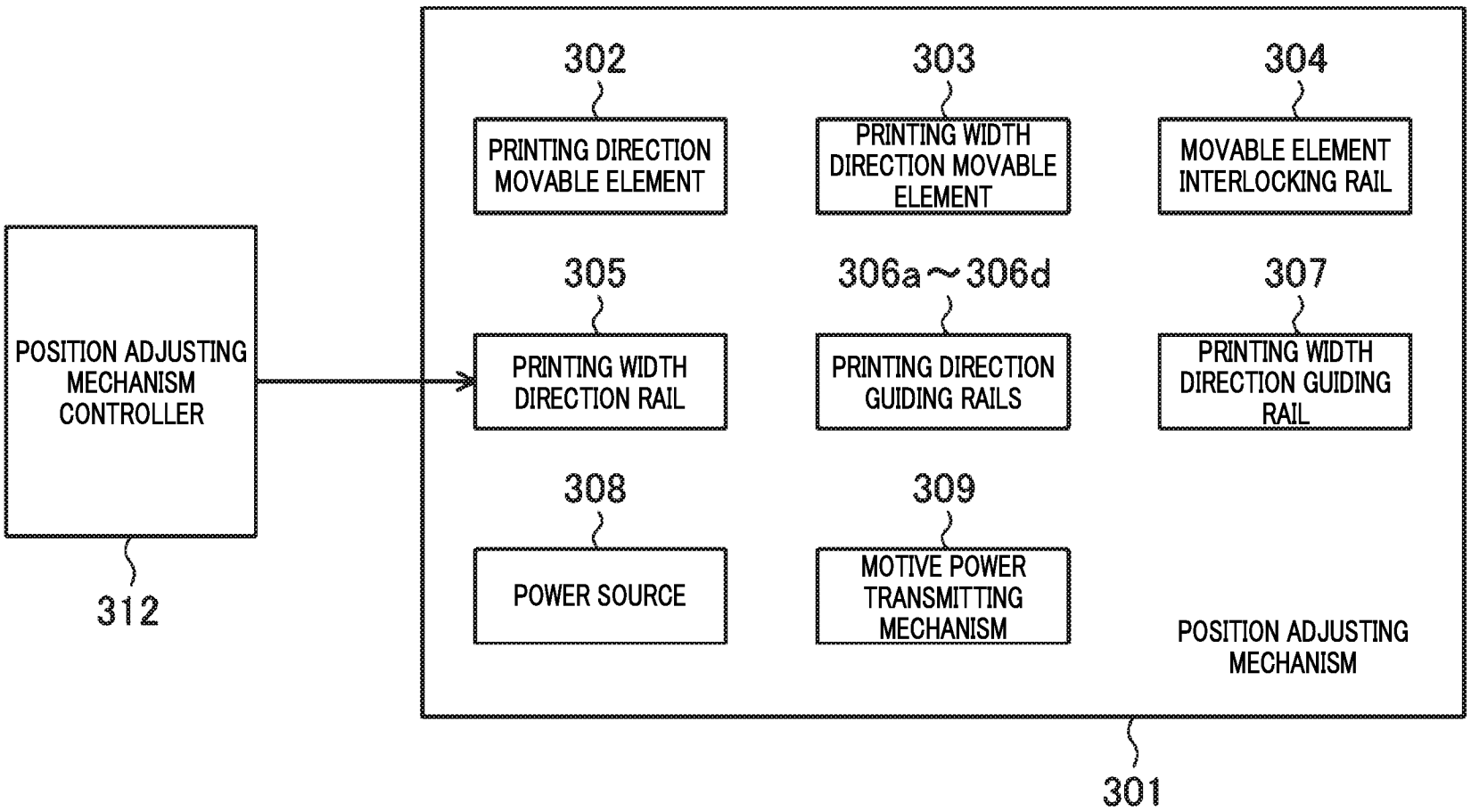
FIG. 5 is a block diagram of position adjusting mechanism, and position adjusting mechanism controller of inkjet device according to Embodiment 3.

FIG. 4 illustrates ink jet device 300 according to Embodiment 3 of the present invention. In Embodiment 3, position adjusting mechanism 301 and position adjusting mechanism controller 312 illustrated in FIG. 5 are provided instead of position adjusting mechanism 106 and position adjusting mechanism controller 108 of Embodiment 1.

Position adjusting mechanism 301 has four sets of printing direction movable element 302 and printing width direction movable element 303, movable element interlocking rail 304 as an interlocking mechanism, a pair of printing width direction rails 305, first to fourth printing direction guiding rails 306*a* to 306*d*, printing width direction guiding rail 307, power source 308 such as the motor, and motive power transmitting mechanism 309. In Embodiment 3, four ink jet heads 105 are referred to as first to fourth ink jet heads 1051 to 1054 in order from the right side in FIG. 4. The interval between nozzles 105*a* from first to fourth ink jet heads 1051 to 1054 is common.

Printing direction movable element 302 is connected to rotating shaft 109 at one end in a longitudinal direction of each of ink jet heads 1051 to 1054. Curves 302*a* are formed on the both sides in printing width direction Y of the both end surfaces at front and rear in printing direction X of printing direction movable element 302. Rotating shaft 310 that projects upward or downward, that is, in a direction perpendicular to the print surface of display panel 103 is fixed on the other longitudinal end of each of ink jet heads 1051 to 1054. Printing width direction movable element 303 is connected to rotating shaft 310. Ink jet head 105 is rotatable about rotating shaft 109, 310 relative to printing direction movable element 302 and printing width direction movable element 303. That is, each of first to fourth ink jet heads 1051 to 1054 is relatively rotatably connected to one of the plurality of printing width direction movable elements 303 at one end thereof, and is relatively rotatably connected to one of the plurality of printing direction movable elements 302 at the other end thereof.

Movable element interlocking rail 304 which extends in printing width direction Y and is disposed so as to be shiftable in printing direction X has rectangular long hole 304*a* which penetrates in the vertical direction and is long in printing width direction Y. The width of long hole 304*a* in printing direction X is set slightly longer than the width of printing direction movable element 302. Movable element interlocking rail 304 accommodates four printing direction movable elements 302 in long hole 304*a*, thereby aligning the positions of four printing direction movable elements 302 in printing direction X. The both end surfaces at front and rear in printing direction X of printing direction movable element 302 contact with the inner circumferential surface of long hole 304*a*, or are faced to the inner circumferential surface of long hole 304*a* from the inside with a minute gap. With such a configuration, movable element interlocking rail 304 interlocks four printing direction movable element 302 in a direction along printing direction X in a state of movable in printing direction X, that is, movable along movable element interlocking rail 304. That is, each of printing direction movable elements 302 is movably disposed along movable element interlocking rail 304.

Printing width direction rail 305 extends in printing width direction Y on both side at front and rear in printing direction X of four ink jet heads 105.

First to fourth printing direction guiding rails 306*a* to 306*d* are formed in an elongated shape extending in printing direction X, and are disposed in parallel with each other in order from the right side in FIG. 4. Both ends of first to fourth printing direction guiding rails 306*a* to 306*d* are connected to printing width direction rail 305 through bearings 311, and are guided in printing width direction Y by printing width direction rail 305. That is, both ends of first to fourth printing direction guiding rails 306*a* to 306*d* are disposed so as to be shiftable in printing width direction Y. The vicinities of one end of each of first to third printing direction guiding rails 306*a* to 306*c* are fixed in order, to printing width direction movable elements 303 connected to second to fourth ink jet heads 1052 to 1054. Printing direction movable element 302 connected to first to fourth ink jet heads 1051 to 1054 is slidably engaged in order, in a direction along printing direction X, at a position closer to the other end than printing width direction movable element 303 in first to fourth printing direction guiding rails 306*a* to 306*d*. That is, first to third printing direction guiding rails 306*a* to 306*c* are fixed to printing width direction movable elements 303 connected to one of the pair of ink jet heads 105 adjacent to each other, and guides printing direction movable element 302 connected to the other ink jet head 105 along printing direction X.

On printing width direction guiding rail 307 disposed so as to extend in printing width direction Y, printing width direction movable element 303 is disposed slidably in printing width direction Y. Note that printing width direction movable element 303 may be moved through a rolling member such as a roller relative to printing width direction guiding rail 307.

Motive power transmitting mechanism 309 is connected to one of the plurality of printing width direction movable element 303, in the present Embodiment, printing width direction movable element 303 connected to first ink jet head 1051. Motive power transmitting mechanism 309 move printing width direction movable element 303 in printing width direction Y, by transmitting the power of power source 308 to printing width direction movable element 303 connected to first ink jet head 1051. Note that motive power transmitting mechanism 309 may be connected to printing width direction movable element 303 other than printing width direction movable element 303 connected to first ink jet head 1051.

Position adjusting mechanism controller 312 stores in advance the interval in the longitudinal direction of nozzles 105*a* of first to fourth ink jet heads 1051 to 1054. Position adjusting mechanism controller 312 controls power source 308 based on the previously stored interval of nozzles 105*a* so that the interval of nozzles 105*a* in printing width direction Y becomes the interval of coloring region 103*b* in display panel 103 in printing width direction Y.

The function of position adjusting mechanism controller 312 is realized by the CPU (Central Processing Unit) and/or the like such as the personal computer.

In ink jet device 300 of Embodiment 3, when printing width direction movable element 303 connected to first ink jet head 1051 is moved in the right direction (one direction of printing width direction Y) in FIG. 4 by the driving of power source 308, the end of printing width direction movable element 303 side connected to first ink jet head 1051 is pulled in the right direction in FIG. 4. Then, first ink jet head 1051 is rotated in a direction to increase angle θ around rotating shaft 109, and printing direction movable element 302 connected to first ink jet head 1051 moves in the downward direction (one direction along printing direction X) and the right direction in FIG. 4. Thus, movable element interlocking rail 304 is pushed downward in FIG. 4, and printing direction movable element 302 connected to second ink jet head 1052 also moves downward (one direction along printing direction X) in FIG. 4 by interlocking with printing direction movable element 302 connected to first ink jet head 1051. The moving force to the right side in FIG. 4 of printing direction movable element 302 connected to first ink jet head 1051 is transmitted to printing width direction movable element 303 connected to second ink jet head 1052 through first printing direction guiding rail 306*a*, and printing width direction movable element 303 moves rightward in FIG. 4. When printing width direction movable element 303 connected to second ink jet head 1052 moves rightward, second ink jet head 1052 rotates in the direction to increase angle θ. The moving force of movable element interlocking rail 304 and first printing direction guiding rail 306*a* is also transmitted to third and fourth ink jet heads 1053 and 1054, and all of first to fourth ink jet heads 1051 to 1054 rotate in the direction to increase angle θ and move rightward in FIG. 4.

All of first to fourth ink jet heads 1051 to 1054 can be rotated in a direction to reduce angle θ and moved leftward in FIG. 4, by moving printing width movable element 303 connected to first ink jet head 1051 leftward in FIG. 4 by the driving of power source 308. In this way, inclination angle θ and the interval in printing width direction Y of first to fourth ink jet heads 1051 to 1054 can be changed simultaneously only by moving printing width direction movable element 303 connected to first ink jet head 1051 in printing width direction Y.

Since the other configuration is the same as that of Embodiment 1, the same components are denoted by the same reference numerals, and detailed description thereof is omitted.

Therefore, according to Embodiment 3, since the position of the plurality of ink jet heads 105 can be adjusted by one power source 308, the number of power sources 308 can be reduced, and the cost and the weight of ink jet device 300 can be reduced.

Since curves 302*a* are formed on the both ends in printing width direction Y of the both end surfaces at front and rear in printing direction X of printing direction movable element 302, when printing direction movable element 302 starts to move in printing width direction Y, it is possible to prevent that printing direction movable element 302 is caught on the inner peripheral surface of long hole 304*a* of movable element interlocking rail 304 by the act of a large frictional force.

Modification of Embodiment 3

In Embodiment 3, instead of forming curves 302*a* on printing direction movable element 302, position adjusting mechanism controller 312 may control power source 308 to move printing width direction movable element 303 connected to first ink jet head 1051 in printing width direction Y while vibrating in printing width direction Y. In this manner, when printing direction movable element 302 starts to move in printing width direction Y, it is possible to prevent that printing direction movable element 302 is caught on the inner peripheral surface of long hole 304*a* of movable element interlocking rail 304 by the frictional force.

In order to prevent printing direction movable element 302 from being caught on the inner peripheral surface of long hole 304*a* of movable element interlocking rail 304 by the frictional force, a play may be provided between printing direction movable element 302 and movable element interlocking rail 304. In such a case, it is possible to suppress the positional variation due to the provision of play, by providing a mechanism for finely adjusting the position of printing direction movable element 302 manually, or moving in a predetermined direction, such as right to left in FIG. 4, at the time of controlling the speed of power source 308 or completing the position adjustment of printing width direction movable element 303.

Embodiment 4

Figure 6:
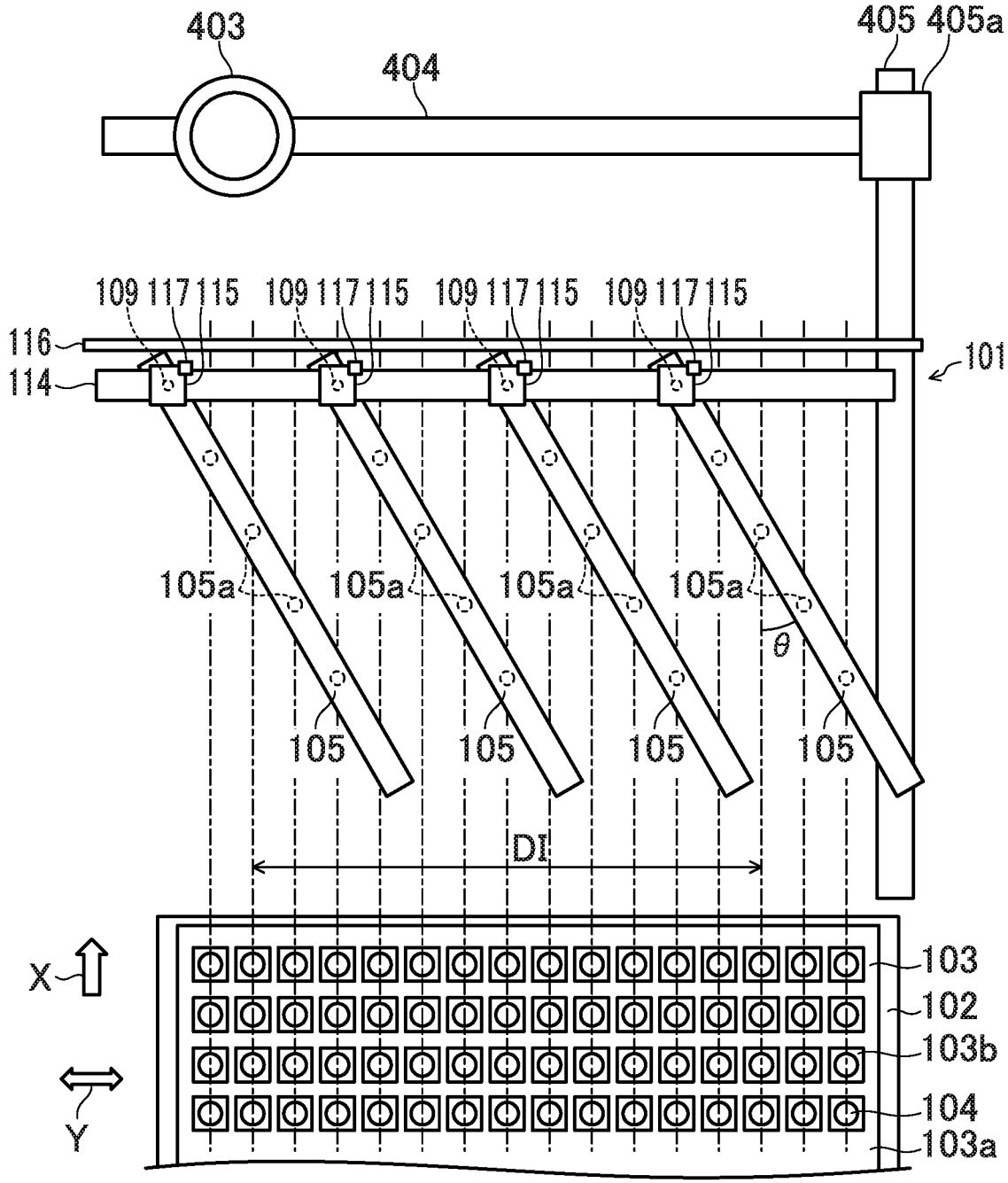
FIG. 6 is a diagram corresponding to FIG. 1 of Embodiment 4.
Figure 7:
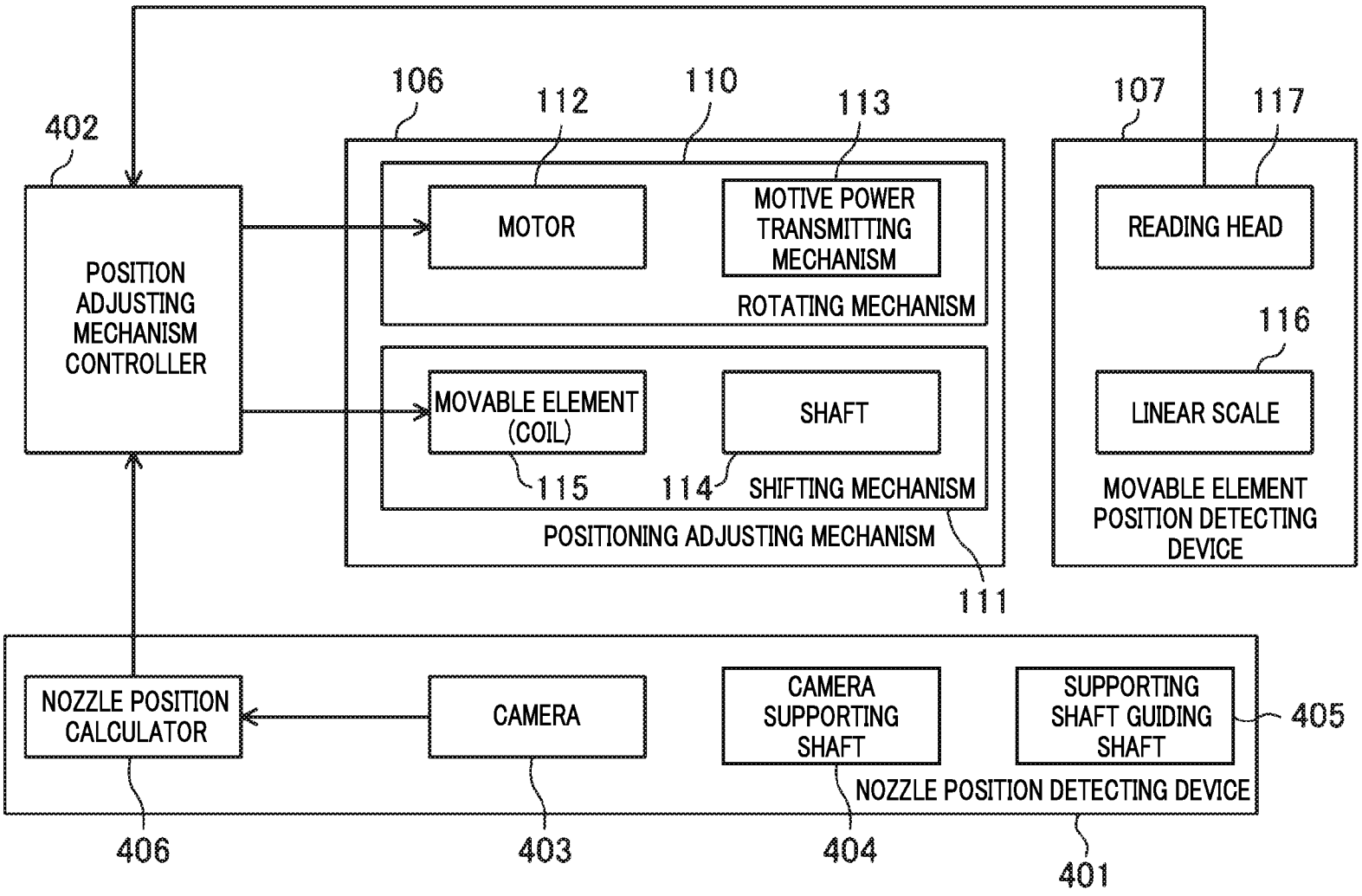
FIG. 7 is a block diagram of movable element position detecting device, position adjusting mechanism, nozzle position detecting device, and position adjusting mechanism controller of ink jet device according to Embodiment 4.

FIG. 6 illustrates ink jet device 400 according to Embodiment 4 of the present invention. In Embodiment 4, ink jet device 400 has nozzle position detecting device 401 as illustrated in FIG. 7, and has position adjusting mechanism controller 402 instead of position adjusting mechanism controller 108 of Embodiment 1.

Nozzle position detecting device 401 detects the position of nozzle 105*a*. Nozzle position detecting device 401 has camera 403, camera supporting shaft 404, supporting shaft guiding shaft 405, and nozzle position calculator 406.

Camera 403 is disposed below four ink jet heads 105 so as to direct the direction facing nozzles 105*a*, that is, upward.

Camera supporting shaft 404 extends in printing width direction Y and supports camera 403 from below slidably in printing width direction Y. Camera supporting shaft 404 has movable element (not illustrated). Camera 403 is attached to camera supporting shaft 404 through the movable element. This movable element incorporates the coil (electromagnet) wound so as to surround camera supporting shaft 404 from the outer peripheral side, and configures a shaft motor together with camera supporting shaft 404.

Supporting shaft guiding shaft 405 extends in printing direction X, and supports one end of camera supporting shaft 404 in printing width direction Y from below slidably in a direction along printing direction X. Supporting shaft guiding shaft 405 has connecting unit 405*a*. Connecting unit 405*a* incorporates the coil (electromagnet) wound so as to surround supporting shaft guiding shaft 405 from the outer peripheral side, and configures a shaft motor together with supporting shaft guiding shaft 405. Therefore, camera 403 can move freely in printing direction X and printing width direction Y, and thus, can move under any nozzle 105*a* as a photographed object.

Nozzle position calculator 406 calculates the center position of nozzle 105*a* as the position of nozzle 105*a* by image recognition based on the image photographed by camera 403.

Position adjusting mechanism controller 402 stores in advance the interval in the longitudinal direction of nozzles 105*a* of each of ink jet heads 105.

Figure 8:
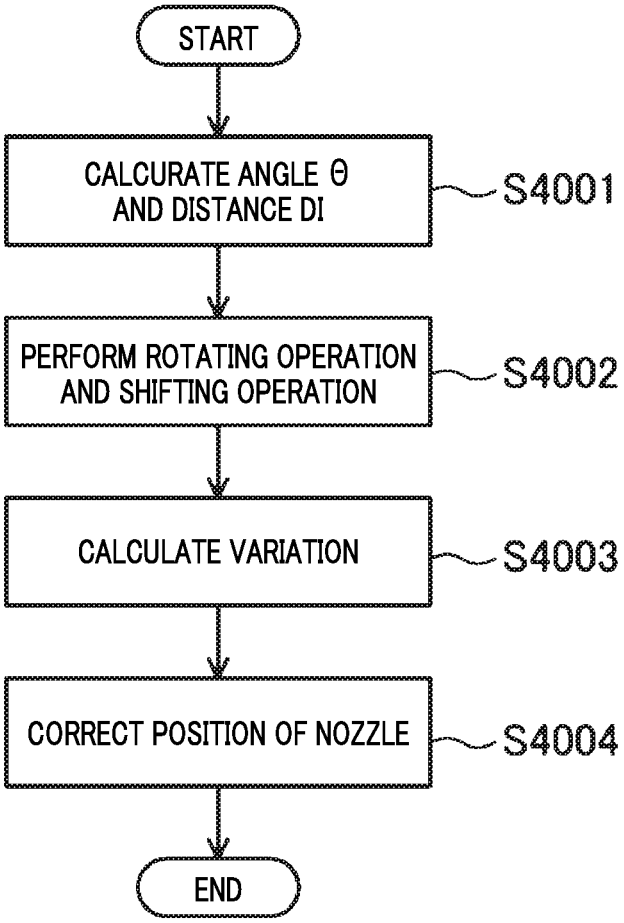
FIG. 8 is a flowchart for explaining the adjusting operation of the nozzle position by position adjusting mechanism controller of ink jet device according to Embodiment 4.

Position adjusting mechanism controller 402 performs an adjusting operation of the nozzle position as illustrated in FIG. 8, based on the detection result of nozzle position detecting device 401.

First, in (S4001), position adjusting mechanism controller 402 calculates angle θ of ink jet head 105, based on the interval of coloring regions 103*b* in the display panel 103 in printing width direction Y and the stored interval of nozzles 105*a*. Here, the position of leftmost nozzle 105*a* of leftmost ink jet head 105 is set as a reference position. Position adjusting mechanism controller 402 calculates distance DI from the reference position to leftmost nozzle 105*a* of each of ink jet heads 105, by multiplying the total number of nozzles 105*a* of the other ink jet head 105 on the left side of leftmost nozzle 105*a* of each of ink jet heads 105 and the interval of the desired nozzles 105*a*, that is, the interval of coloring regions 103*b* in printing width direction Y. In FIG. 6, only distance DI calculated for rightmost ink jet head 105 is illustrated.

Next, in (S4002), position adjusting mechanism controller 402 causes rotating mechanism 110 to performed the rotating operation based on calculated angle θ, and causes shifting mechanism 111 to perform the shifting operation based on calculated distance DI.

Thereafter, in (S4003), position adjusting mechanism controller 402 calculates a variation between the position of nozzle 105*a* detected by nozzle position detecting device 401 after the operation of (S4002) and the position of the desired nozzle 105*a*.

In (S4004), position adjusting mechanism controller 402 causes rotating mechanism 110 to perform the rotating operation and causes shifting mechanism 111 to perform the shifting operation, so that the average of the variations calculated for the positions of nozzles 105*a* at both ends of four ink jet heads 105 becomes small. Thus, the position of nozzle 105*a* is corrected.

The functions of nozzle position calculator 406 and position adjusting mechanism controller 402 are realized by the CPU (Central Processing Unit) and/or the like such as the personal computer.

Since the other configuration is the same as that of Embodiment 1, the same components are denoted by the same reference numerals, and detailed description thereof is omitted.

Therefore, according to Embodiment 4, nozzle 105*a* can be moved to the desired position more reliably.

Since position adjusting mechanism controller 402 controls position adjusting mechanism 106 so that the average of the variations of nozzles 105*a* at both ends of four ink jet heads 105 becomes small, it is possible to suppress the appearance of periodic shading in the image of display panel 103 due to the positional variation of nozzles 105*a* at both ends of ink jet heads 105.

Modification of Embodiment 4

In the above Embodiment 4, in (S4004), position adjusting mechanism controller 402 controls position adjusting mechanism 106 so that the average of the variations of nozzles 105*a* at both ends of four ink jet heads 105 becomes small. However, in (S4004), position adjusting mechanism controller 402 may control position adjusting mechanism 106 so that the average of the variations of all nozzles 105*a* of four ink jet heads 105 becomes small.

Embodiment 5

Figure 9:
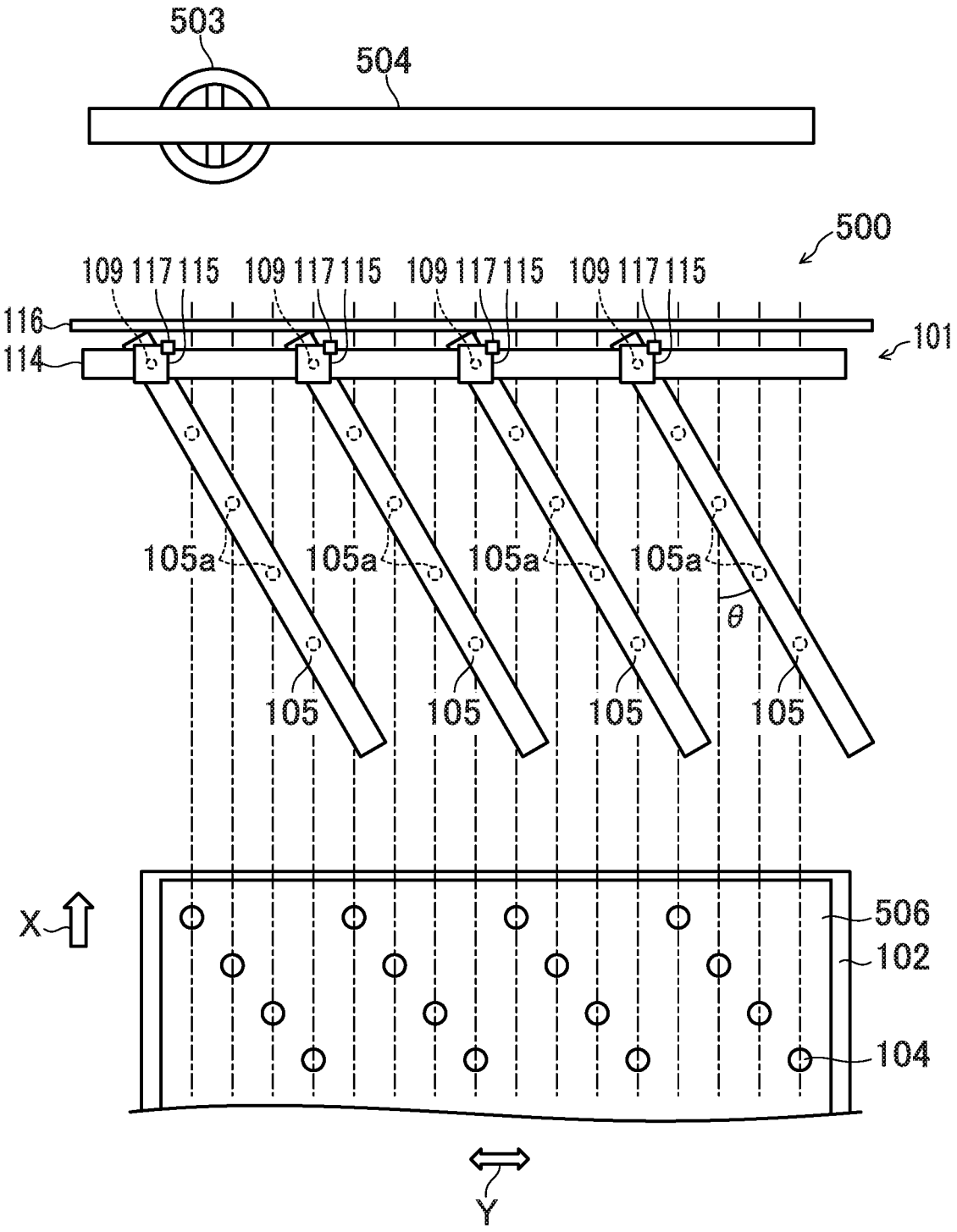
FIG. 9 is a diagram corresponding to FIG. 1 of Embodiment 5.
Figure 10:
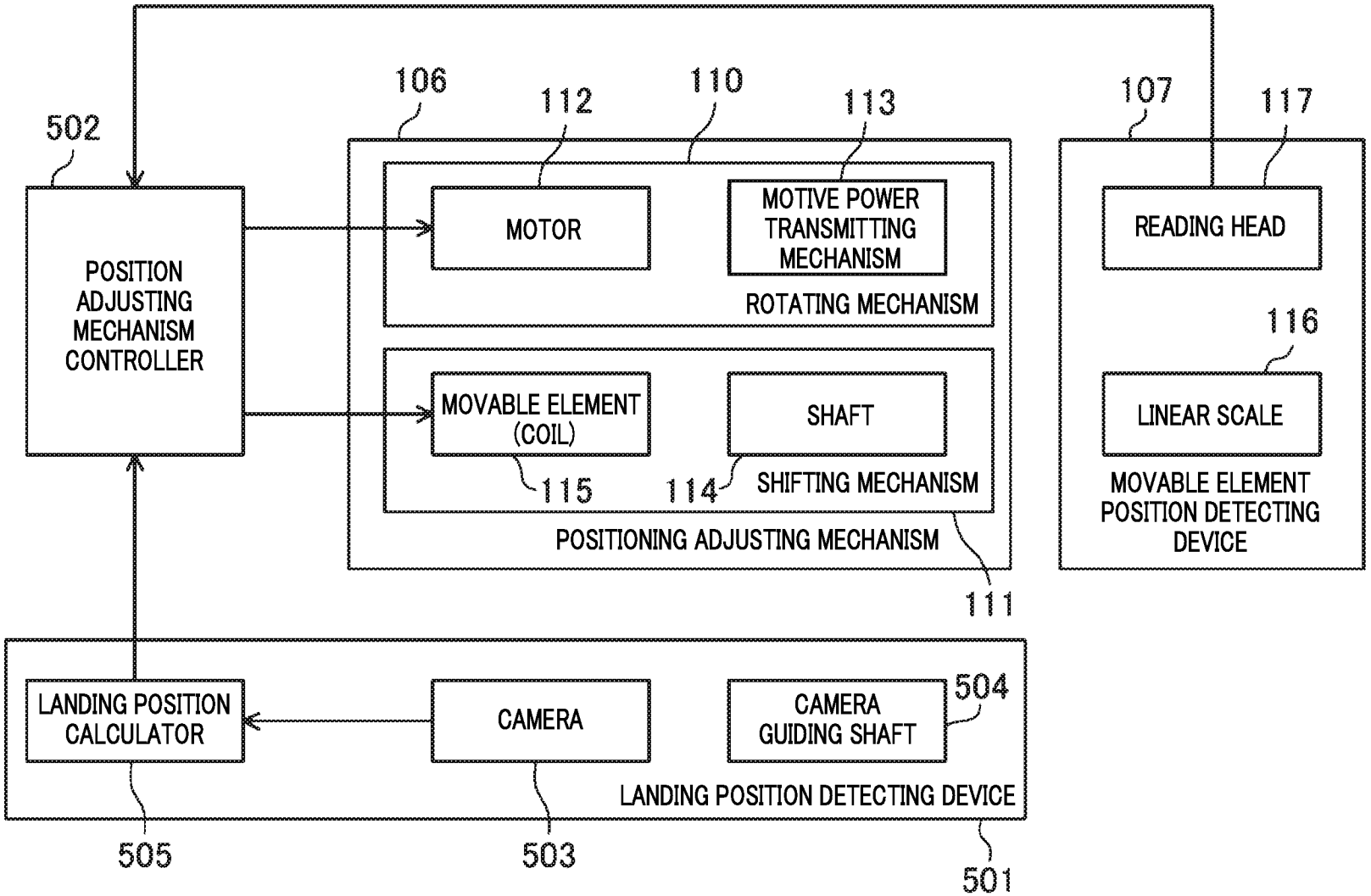
FIG. 10 is a block diagram of movable element position detecting device, position adjusting mechanism, landing position detecting device, and position adjusting mechanism controller of ink jet device according to Embodiment 5.

FIG. 9 illustrates ink jet device 500 according to Embodiment 5 of the present invention. In Embodiment 5, ink jet device 500 has landing position detecting device 501 and position adjusting mechanism controller 502 as illustrated in FIG. 10, instead of nozzle position detecting device 401 and position adjusting mechanism controller 402 of Embodiment 4.

Landing position detecting device 501 detects the landing position of ink 104 in the print object after printing. Landing position detecting device 501 has camera 503, camera guiding shaft 504, and landing position calculator 505.

Camera 503 photographs the print surface of the print object after printing. Therefore, camera 503 is disposed so as to direct the direction of facing printing stage 102, that is, downward. As camera 503, a line camera in which imaging elements are disposed on a line extending in printing width direction Y is used.

Camera guiding shaft 504 has a movable element (not illustrated). Camera 503 is attached to camera guiding shaft 504 through the movable element. The movable element incorporates the coil (electromagnet) wound so as to surround camera guiding shaft 504 from the outer peripheral side, and configures a shaft motor together with camera guiding shaft 504. Therefore, camera 503 can move freely in printing width direction Y, and thus, can move over the ink after any landing of the photographed object.

Landing position calculator 505 calculates the landing position of ink 104 based on an image photographed by camera 503.

Position adjusting mechanism controller 502 stores in advance the interval between nozzles 105*a* of each of ink jet heads 105.

Position adjusting mechanism controller 502 performs the following adjusting operation of the nozzle position based on the detection result of landing position detecting device 501.

First, position adjusting mechanism controller 502 performs the operation of the above (S4001) and (S4002), similarly to position adjusting mechanism controller 402 of Embodiment 4

Next, position adjusting mechanism controller 502 ejects ink 104 from all of nozzles 105*a* of all ink jet heads 105 in drops by drops and makes it land on testing display panel 506 as the print object. As testing display panel 506 on which ink 104 is landed, a clean panel having no structure such as bank 103*a* and no dirt attached thereto is used in order to minimize the movement of ink 104 after the landing due to the surface tension and/or the like.

Thereafter, position adjusting mechanism controller 502 calculates a variation in printing width direction Y between the landing position calculated by landing position calculator 505 based on the image of testing display panel 506 photographed by camera 503 after ejection (after printing) of ink 104, and a desired landing position Position adjusting mechanism controller 502 corrects the position of nozzles 105*a* so that the average of the variations calculated for the positions of ink 104 ejected from nozzles 105*a* at both ends of four ink jet heads 105 becomes small. Position adjusting mechanism controller 502 corrects the position of nozzle 105*a* by causing rotating mechanism 110 to perform the rotating operation and causing shifting mechanism 111 to perform the shifting operation. Note that position adjusting mechanism controller 502 may correct the position of nozzles 105*a* so that the average of the positional variations of ink 104 ejected from all nozzles 105*a* of four ink jet heads 105 becomes small.

Thereafter, position adjusting mechanism controller 502 ejects ink 104 from all nozzles 105*a* of all ink jet heads 105, and lands it on testing display panel 506.

Thereafter, position adjusting mechanism controller 502 calculates a variation in printing direction X between the landing position detected by landing position detecting device 501 after the ejection of ink 104 to testing display panel 506 and the desired landing position. The ejection timing of ink 104 from each of nozzles 105*a* is set so that the variation of the landing position of ink 104 in printing direction X ejected from each of nozzles 105*a* becomes small.

The functions of landing position calculator 505 and the position adjusting unit controller 502 are realized by the CPU (Central Processing Unit) and/or the like such as the personal computer.

Since the other configuration is the same as that of Embodiment 4, the same components are denoted by the same reference numerals, and detailed description thereof is omitted.

Therefore, according to Embodiment 5, the position of ink jet head 105 can be adjusted so that ink 104 is ejected to the desired landing position even when the ejecting angle of ink 104 of nozzle 105*a* varies.

Embodiment 6

Figure 11:
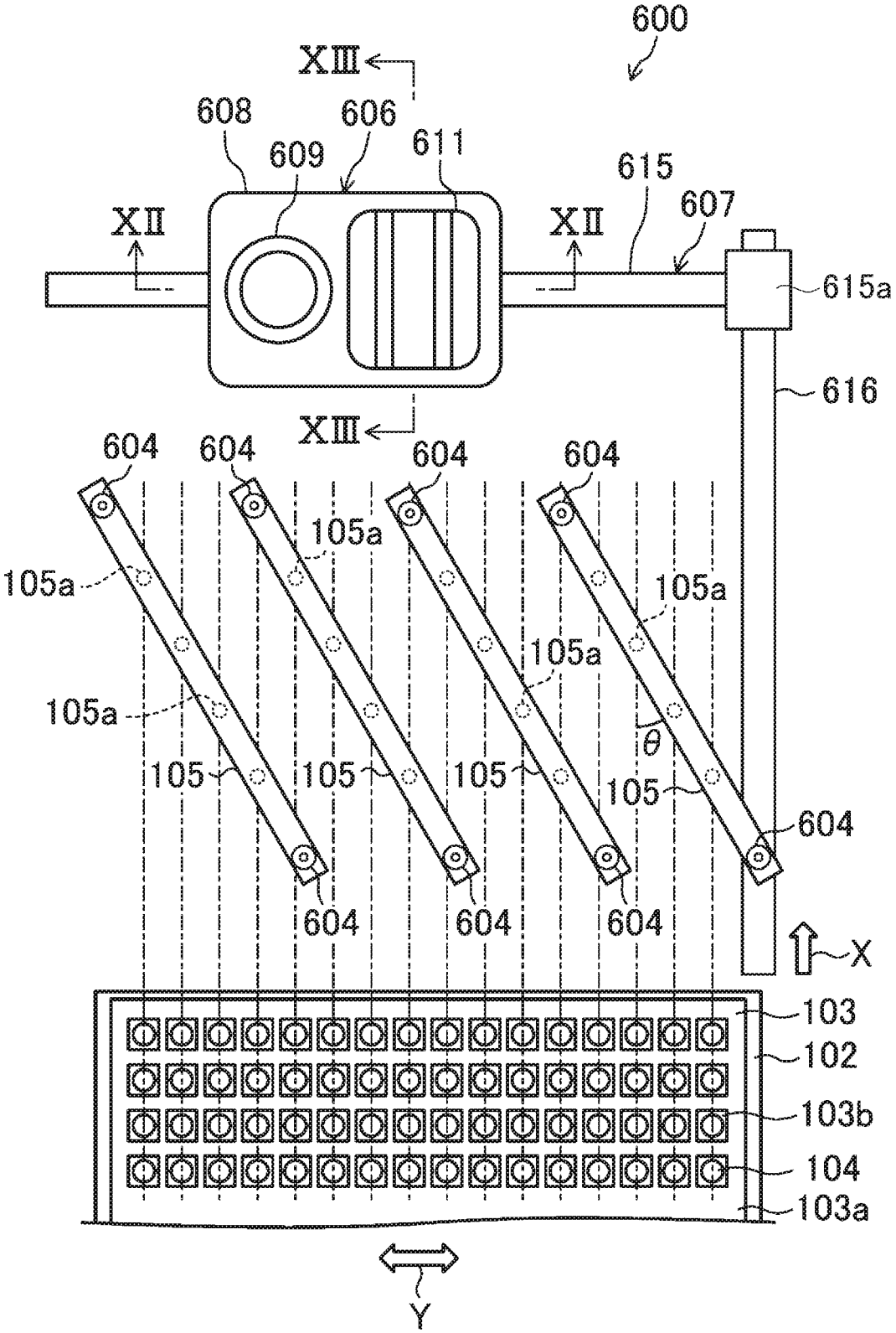
FIG. 11 is a diagram corresponding to FIG. 1 of Embodiment 6.
Figure 12:
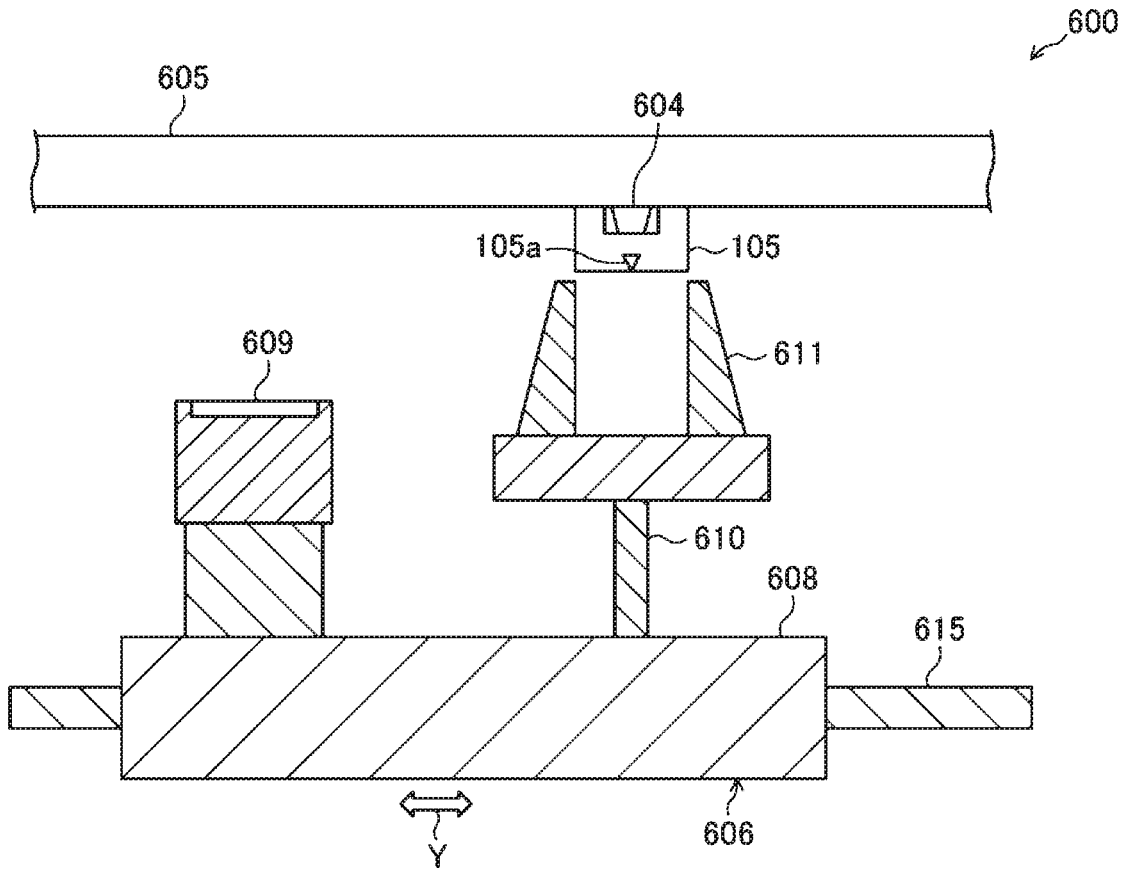
FIG. 12 is a cross sectional view corresponding to XII-XII line of FIG. 11.
Figure 13:
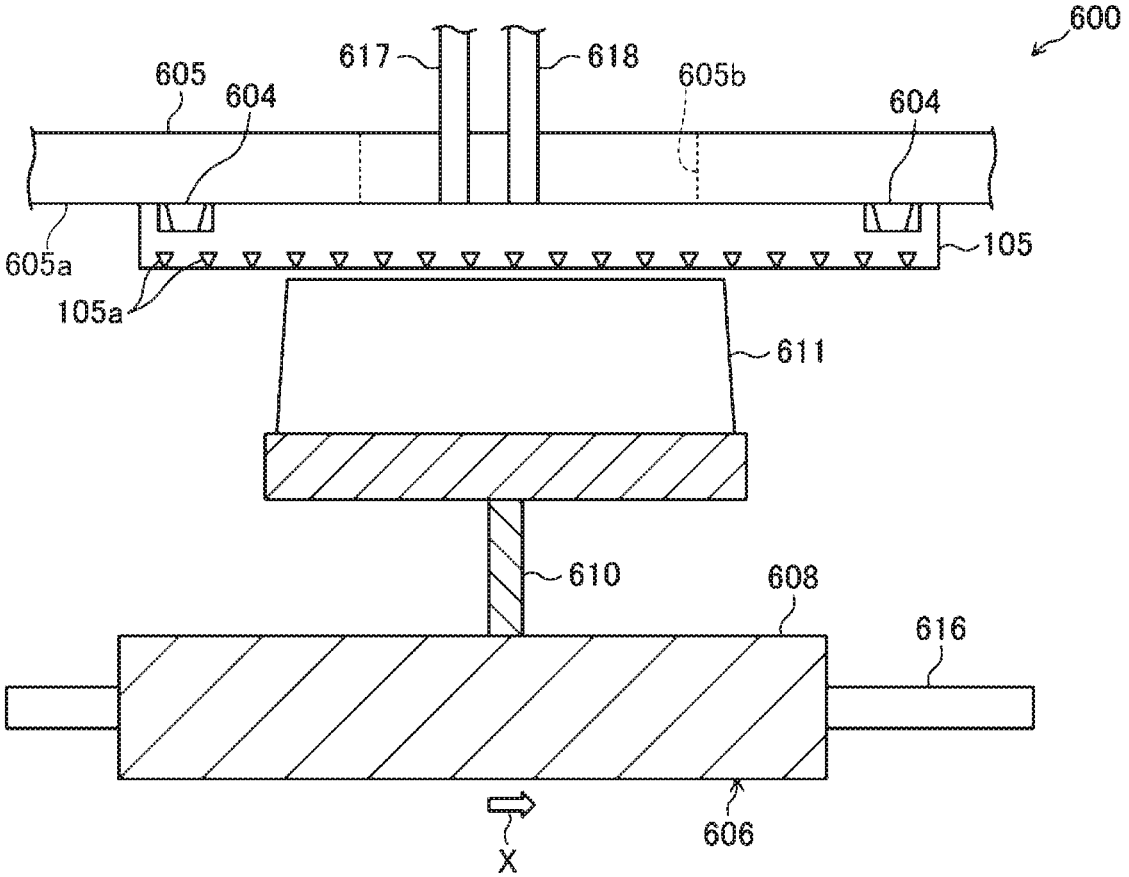
FIG. 13 is a cross sectional view corresponding to XIII-XIII line of FIG. 11.
Figure 14:
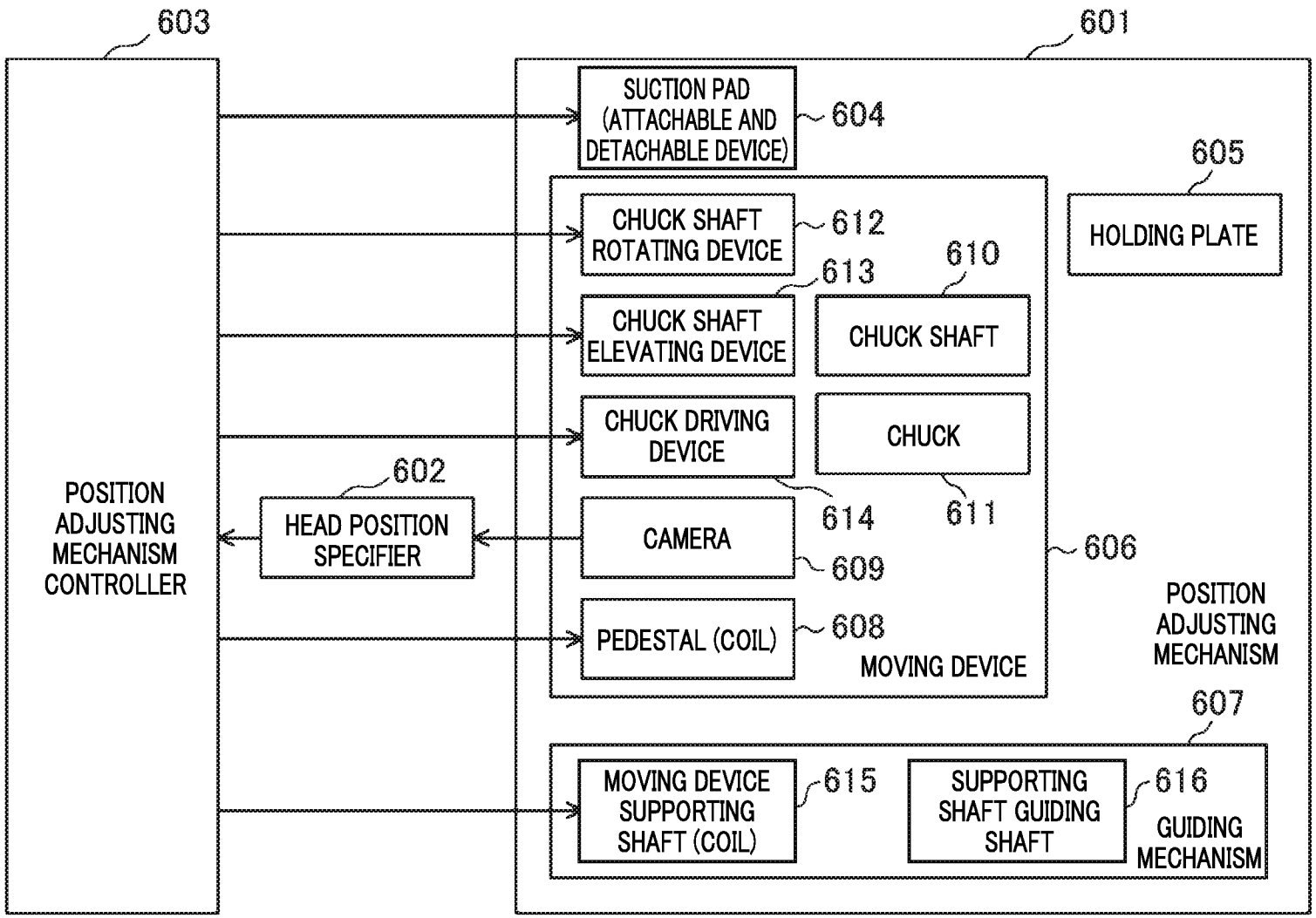
FIG. 14 is a block diagram of position adjusting mechanism, head position specifier, and position adjusting mechanism controller of ink jet device according to Embodiment 6.

FIG. 11 to FIG. 13 illustrate ink jet device 600 according to Embodiment 6 of the present invention. In Embodiment 6, position adjusting mechanism 601, head position specifier 602, and position adjusting mechanism controller 603 illustrated in FIG. 14 are provided instead of position adjusting mechanism 106, movable element position detecting device 107, and position adjusting mechanism controller 108 of Embodiment 1. In Embodiment 6, fall preventing wire 617 for preventing ink jet head 105 from falling due to equipment trouble is connected to each of ink jet heads 105. Fall preventing wire 617 is preferably attached near the longitudinal center of ink jet head 105 for preventing one end of ink jet head 105 from lowered too much when ink jet head 105 is suspended by fall preventing wire 617. In FIG. 13, reference numeral 618 denotes a utility cable that transmits a control signal of ink jet head 105 and supplies ink. It is needless to say that utility cable 618 may be divided into a signal cable and an ink supply cable.

Position adjusting mechanism 601 has holding plate 605 as a holding member, suction pad 604 as a plurality of attachable and detachable devices, moving device 606 as a moving unit, and guiding mechanism 607.

Holding plate 605 is disposed so as to face ink jet head 105 from above (direction opposite to ejection of ink 104). Holding plate 605 has plane 605*a* facing moving device 606. Plane 605*a* is a lower surface of holding plate 605. Holding plate 605 has at least one through hole 605*b*. Fall preventing wire 617 and utility cable 618 passes through the through hole 605*b*.

Suction pads 604 are fixed to the upper surfaces of both ends of ink jet head 105 in a state that their suction surfaces face upward. Suction pad 604 is attached to or detached from holding plate 605, specifically, plane 605*a*. Suction pad 604 can be attached by suction to the suction object by generating a negative pressure between the suction surface thereof and holding plate 605. Suction pads 604 can be fixed to both ends of each of ink jet heads 105 one by one. It is needless to say that the position and the number of suction pads 604 are not limited to such a configuration. Note that it is preferable that the upper surface of ink jet head 105 is formed of a flat surface, and suction pad 604 is disposed in a state in which it is flush with the flat surface or in a state in which it is recessed from the flat surface. By disposing in such a manner, it is possible to bring the upper surface of ink jet head 105 into surface contact with plane 605*a* of holding plate 605, and thus, it is easy to equalize the distance between each of nozzles 105*a* and holding plate 605. That is, the distance between each of nozzles 105*a* and display panel 103 as the print object can be easily equalized.

Moving device 606 has pedestal 608. Pedestal 608 incorporates a coil. Camera 609 is disposed in a state of directing the photographing direction upward, and chuck shaft 610 capable of rotation and vertical movement is projected upward, on the upper surface of pedestal 608. The projecting direction of chuck shaft 610 is a direction perpendicular to the print surface of display panel 103. Chuck 611 is fixed on the tip of chuck shaft 610. Moving device 606 has chuck shaft rotating device 612 for rotating chuck shaft 610, chuck shaft elevating device 613 for moving chuck shaft 610 vertically, and chuck driving device 614 for opening or closing chuck 611. That is, chuck shaft 610 connects pedestal 608 and chuck 611 in a state that they can rotate relatively and can be closed to or separated from each other.

Guiding mechanism 607 has moving device supporting shaft 615, and supporting shaft guiding shaft 616. Guiding mechanism 607 guides moving device 606 in the direction along printing direction X and in printing width direction Y.

Moving device supporting shaft 615 extends in printing width direction Y. Pedestal 608 of moving device 606 is supported from below slidably in printing width direction Y. A permanent magnet is incorporated in moving device supporting shaft 615. The coil of pedestal 608 is positioned so as to surround moving device supporting shaft 615 from the outer peripheral side. It is possible to move pedestal 608 to any position in printing width direction Y, by controlling the current flowing through the coil of pedestal 608. Connecting unit 615*a* is provided at one end portion in printing width direction (the end portion of right side in FIG. 11) of moving device supporting shaft 615. The coil is also incorporated in connecting unit 615*a*.

Supporting shaft guiding shaft 616 extends in printing direction X. Connecting unit 615*a* of moving device supporting shaft 615 is connected to supporting shaft guiding shaft 616 slidably in a direction along printing direction X. The permanent magnet is also incorporated in supporting shaft guiding shaft 616. The coil of connecting unit 615*a* is positioned so as to surround supporting shaft guiding shaft 616 from the outer peripheral side. Moving device supporting shaft 615 can be moved to any position in the direction along printing direction X, by controlling the current flowing through the coil of connecting unit 615*a*.

Head position specifier 602 specifies the present position of ink jet head 105 based on an image photographed by camera 609. The position is specified by, for example, recognition of the outer shape of ink jet head 105 or recognition of a mark previously attached to ink jet head 105. The function of head position specifier 602 is realized by the CPU (Central Processing Unit) such as the personal computer. Note that moving device supporting shaft 615 is longer than the length in printing width direction Y of the region where the plurality of ink jet heads 105 is disposed. Supporting shaft guiding shaft 616 is also longer than the length in printing direction X of the region where the plurality of ink jet heads 105 is disposed. Therefore, camera 609 can move under any nozzle 105*a* as the photographed object. Note that camera 609 may be disposed in a state of directing the photographing direction of camera 609 downward on the lower surface of pedestal 608. In this case, camera 609 can photograph the position of the ink after landing. In this case, the landing position calculator is provided instead of head position specifier 602.

Position adjusting mechanism controller 603 performs the following position adjusting operation for each of ink jet heads 105.

First, in a state where ink jet head 105 as an adjusted object is attached through suction pad 604 to holding plate 605, position adjusting mechanism controller 603 moves moving device 606 below ink jet head 105. Moving device 606 can be moved by controlling the current flowing through the coils of pedestal 608 and connecting unit 615*a*.

Then, position adjusting mechanism controller 603 moves moving device 606 so that chuck 611 of moving device 606 is positioned directly below ink jet head 105 as the adjusted object, based on the present position specified by head position specifier 602.

Position adjusting mechanism controller 603 moves chuck shaft 610 upward under the control of the chuck shaft elevating device 613 in a state in which chuck 611 of moving device 606 is disposed directly below ink jet head 105 as the adjusted object, and causes chuck 611 to pinch ink jet head 105 and to hold by chuck 611 under the control of chuck driving device 614.

In this state, position adjusting mechanism controller 603 stops generating a negative pressure between the suction surface of suction pad 604 and holding plate 605 (that is, turns off suction on suction pad 604), thereby suction pad 604 is separated from holding plate 605. Position adjusting mechanism controller 603 lowers chuck shaft 610, under the control of chuck shaft elevating device 613.

Thereafter, position adjusting mechanism controller 603 moves moving device 606 to a desired position so that ink jet head 105 is positioned at a desired position in printing width direction Y, and rotates chuck shaft 610 under the control of chuck shaft rotating device 612 so that angle θ of ink jet head 105 becomes a desired angle. Thus, ink jet head 105 is rotated in a state held by chuck 611 around chuck shaft 610. Position adjusting mechanism controller 603 moves chuck shaft 610 upward, and contacts the suction surface of suction pad 604 to holding plate 605, under the control of chuck shaft elevating device 613. Suction pad 604 is attached to holding plate 605 by generating the negative pressure between the suction surface of suction pad 604 and holding plate 605 (that is, turning on the suction of suction pad 604. Thus, ink jet head 105 is fixed to holding plate 605.

Since the other configuration is the same as that of Embodiment 1, the same components are denoted by the same reference numerals, and detailed description thereof is omitted.

Therefore, according to Embodiment 6, since it is not necessary to attach rotating mechanism 110 and shifting mechanism 111 of Embodiment 1 to ink jet head 105, it is possible to reduce the load on the support body for supporting ink jet head 105 from above.

Modification of Embodiment 6

In the above Embodiment 4, position adjusting mechanism 601 of Embodiment 6 may be provided instead of position adjusting mechanism 106, and the movement of ink jet head 105 may be performed in (S4002) and (S4004) by position adjusting mechanism 601.

In the above Embodiment 5, instead of position adjusting mechanism 106, position adjusting mechanism 601 according to Embodiment 6 may be provided, and the movement of ink jet head 105 in the (S4002) and the correcting step of the nozzle position may be performed by position adjusting mechanism 601.

Although suction pad 604 is used as the attachable and detachable device in Embodiment 6, an attachable and detachable device that attaches or detaches in accordance with a magnetic force may be used. Suction pad 604 may be fixed to holding plate 605 by a mechanical fixing method, in addition to the suction by the generation of the negative pressure at the time of printing. Thus, positional variation of ink jet head 105 at the time of printing can be prevented.

(Other Modifications)

In the above Embodiments 1 to 6 and the modification, four ink jet heads 105 are provided in ink jet device 100, however, more than four ink jet heads may be provided.

In the above Embodiments 1 to 6 and the modification, ink jet head 105 has the elongated shape, and nozzles 105*a* are disposed linearly at intervals from each other in the longitudinal direction of ink jet head 105. However, ink jet head 105 may have another shape, and nozzles 105*a* may be disposed linearly at intervals each other in a predetermined arrangement direction.

In the above Embodiments 1 to 6 and the modification, position adjusting mechanism 106, 301, 601 is configured so that all ink jet heads 105 provided can be shifted in the printing width direction, however, only a part of ink jet heads 105 may be configured to be shifted in the printing width direction.

In the above Embodiments 1 to 6 and the modification, instead of position adjusting mechanism 106, 301, 601, a position adjusting mechanism that performs only one of the rotating operation of rotating ink jet head 105 or the shifting operation of shifting at least one of the plurality of ink jet heads 105 in the printing width direction may be provided.

In the above Embodiments 1 to 6 and the modification, display panel 103 is moved during the printing operation in a state that ink jet head 105 is fixed, however, the present invention can also be adapted to an ink jet device that moves ink jet head 105 in a state that the print object is fixed.

In the above Embodiments 1 to 6 and the modification, the present invention is adapted to the printing of display panel 103, however, the present invention can also be adapted to an industrial ink jet device in which a member other than display panel 103 is a print object.

INDUSTRIAL APPLICABILITY

The ink jet device according to the present invention is extremely useful and highly industrially usable, because it has a highly practical effect of reducing printing unevenness occurring in a large print object, even if the ink jet head is not lengthened.

CROSS REFERENCE TO RELATED APPLICATIONS

This application is entitled to the benefit of Japanese Patent Application No. 2019-176070, filed on Sep. 26, 2019 and Japanese Patent Application No. 2020-128361, filed on Jul. 29, 2020, the disclosures of which including the specification, drawings and abstract are incorporated herein by reference in their entirety.

REFERENCE SIGNS LIST

100 Ink jet device
101 Device main body
102 Printing stage
103 Display panel (print object)
103*a* bank

103*b* coloring region
104 Ink
105 Ink jet head
105*a* nozzle
106 Positioning adjusting mechanism
107 Movable element position detecting device
108 Position adjusting mechanism controller
109 Rotating shaft
110 Rotating mechanism
111 Shifting mechanism
112 Motor
113 Motive power transmitting mechanism
114 Shaft
115 Movable element
116 Linear scale
117 Reading head
200 Ink jet device
201 Connecting frame (Connecting unit)
300 Ink jet device
301 Position adjusting mechanism
302 Printing direction movable element
302*a* Curve
303 Printing width direction movable element
304 Movable element interlocking rail (interlocking mechanism)
305 Printing width direction rail
306*a*-306*d* First to fourth printing direction guiding rails
307 Printing width direction guiding rail
308 Power source
309 Motive power transmitting mechanism
310 Rotating shaft
311 Bearing
312 Position adjusting mechanism controller
400 Ink jet device
401 Nozzle position detecting device
402 Position adjusting mechanism controller
403 Camera
404 Camera supporting shaft
405 Supporting shaft guiding shaft
405*a* Connecting unit
406 Nozzle position calculator
500 Ink jet equipment
501 Landing position detecting device
502 Position adjusting mechanism controller
503 Camera
504 Camera guiding shaft
505 Landing position calculator
506 Testing display panel
600 Ink jet device
601 Position adjusting mechanism
602 Head position specifier
603 Position adjusting mechanism controller
604 Suction pad (attachable and detachable device)
605 Holding plate (holding member)
605*a* Plane
605*b* Through hole
606 Moving device
607 Guiding mechanism
608 Pedestal
609 Camera
610 Chuck shaft
611 Chuck
612 Chuck shaft rotating device
613 Chuck shaft elevating device
614 Chuck driving device
615 Moving device supporting shaft
615*a* Connecting unit
616 Supporting shaft guiding shaft
617 Fall preventing wire
618 Utility cable
1051 First ink jet head
1052 Second ink jet head
1053 Third ink jet head
1054 Fourth ink jet head

The invention claimed is:

1. An ink jet device configured to apply ink to a print object at intervals in a printing width direction perpendicular to a printing direction by ejecting ink from a plurality of nozzles disposed at intervals in the printing width direction, comprising:

a plurality of ink jet heads including the plurality of nozzles disposed linearly with each other at intervals in a predetermined disposing direction, the plurality of ink jet heads ejecting ink in different regions from each other in the printing width direction; and a position adjusting mechanism performing a rotating operation of changing the intervals in the printing width direction of the nozzles and performing a shifting operation of shifting at least one of the plurality of ink jet heads in the printing width direction, the rotating operation being performed by rotating the plurality of ink jet heads around an axis perpendicular to the print surface of the print object, wherein the position adjusting mechanism that shifts the at least one of the plurality of ink jet heads comprises:

a shaft disposed to extend in the printing width direction, a movable element disposed movably along the shaft, and a rotating shaft through which the at least one of the plurality of ink jet heads that is shifted and the movable element are connected, the at least one of the plurality of ink jet heads that is shifted being configured to rotate around the rotating shaft, and the movable element is configured to move along the shaft with the at least one of the plurality of ink jet heads that is shifted and the rotating shaft.

2. The ink jet device according to claim 1, further comprising:

a nozzle position detecting device configured to detect a position of the nozzles of the plurality of ink jet heads; and a position adjusting mechanism controller configured to control the position adjusting mechanism based on a detection result of the nozzle position detecting device.

3. The ink jet device according to claim 1, further comprising:

a landing position detecting device configured to detect an ink landing position in the print object after printing; and a position adjusting mechanism controller configured to control the position adjusting mechanism based on a detection result of the landing position detecting device.

4. The ink jet device according to claim 1, wherein the position adjusting mechanism includes:

an attachable and detachable device fixed to the ink jet head;

a holding member configured to hold the ink jet head via the attachable and detachable device;

a moving device configured to hold the ink jet head and rotate the held ink jet head about an axis perpendicular to the print surface of the print object; and a guiding mechanism configured to guide the moving device in the printing width direction.

5. The inkjet device according to claim 4, wherein a fall preventing wire that prevents fall of the inkjet head is connected to the ink jet head, and the holding member has a plane which faces the moving device and to or from which the attachable and detachable device is attached or detached, and a through hole through which the fall preventing wire passes.

6. The inkjet device according to claim 4, wherein the moving device includes a pedestal guided by the guiding mechanism, a chuck configured to hold the ink jet head, and a chuck shaft configured to connect between the pedestal and the chuck such that the pedestal and the chuck are relatively rotatable with each other and are capable of coming close to or separating from each other.

7. The inkjet device according to claim 4, further comprising a camera attached to the moving device.

8. The ink jet device according to claim 1, wherein the position adjusting mechanism further includes:

a motor attached to the movable element and configured to rotate the at least one of the plurality of ink jet heads around the rotating shaft, and the movable element is configured to move along the shaft with the at least one of the plurality of ink jet heads, the rotating shaft, and the motor.

9. An ink jet device configured to apply ink to a print object at intervals in a printing width direction perpendicular to a printing direction by ejecting ink from a plurality of nozzles disposed at intervals in the printing width direction, comprising:

a plurality of ink jet heads including the plurality of nozzles disposed linearly with each other at intervals in a predetermined disposing direction, the plurality of ink jet heads ejecting ink in different regions from each other in the printing width direction; and a position adjusting mechanism performing a rotating operation of changing the intervals in the printing width direction of the nozzles and performing a shifting operation of shifting at least one of the plurality of ink jet heads in the printing width direction, the rotating operation being performed by rotating the plurality of ink jet heads around an axis perpendicular to the print surface of the print object, wherein the position adjusting mechanism shifts a first ink jet head and a second ink jet head among the at least one of the plurality of ink jet heads that is shifted, the position adjusting mechanism comprises:

a shaft disposed to extend in the printing width direction, a first rotating shaft, a second rotating shaft, a movable element disposed movably along the shaft, and a connecting portion, including:

a first end, a second end opposite to the first end, and a center portion located between the first end and the second end, the center portion being fixed to the movable element and wherein the first rotating shaft connects the first end of the connecting portion and one end portion of the first ink jet head, the first ink jet head being configured to rotate around the first rotating shaft, and the second rotating shaft connects the second end of the connecting portion and one end portion of the second ink jet head, the second ink jet head being configured to rotate around the second rotating shaft.

10. The ink jet device according to claim 9, wherein the position adjusting mechanism further includes:

a first motor attached to the one end portion of the first ink jet head and configured to rotate the first ink jet head around the first rotating shaft, and a second motor attached to the one end portion of the second inkjet head and configured to rotate the second ink jet head around the second rotating shaft.

11. An ink jet device configured to apply ink to a print object at intervals in a printing width direction perpendicular to a printing direction by ejecting ink from a plurality of nozzles disposed at intervals in the printing width direction, comprising:

a plurality of ink jet heads including the plurality of nozzles disposed linearly with each other at intervals in a predetermined disposing direction, the plurality of ink jet heads ejecting ink in different regions from each other in the printing width direction; and a position adjusting mechanism performing a rotating operation of changing the intervals in the printing width direction of the nozzles and performing a shifting operation of shifting at least one of the plurality of ink jet heads in the printing width direction, the rotating operation being performed by rotating the plurality of ink jet heads around an axis perpendicular to the print surface of the print object, the position adjusting mechanism includes:

a printing width direction guiding rail disposed to extend in the printing width direction;

a plurality of printing width direction movable elements disposed movably along the printing width direction guiding rail;

a motive power transmitting mechanism connected to one of the plurality of printing width direction movable elements, and configured to move the one of the plurality of printing width direction movable elements in the printing width direction;

a movable element interlocking rail disposed to extend in the printing width direction and to be shiftable in the printing direction;

a plurality of printing direction movable elements disposed movably along the movable element interlocking rail; and a plurality of printing direction guiding rails disposed to extend in the printing direction and to be shiftable in the printing width direction, and configured to guide the plurality of printing direction movable elements in the printing direction, wherein each of the plurality of ink jet heads is relatively rotatably connected to one of the plurality of printing width direction movable elements at one end portion thereof, and is relatively rotatably connected to one of the plurality of printing direction movable elements at another end portion thereof.

* * * * *